US006860396B2

(12) United States Patent
Seppälä

(10) Patent No.: US 6,860,396 B2
(45) Date of Patent: Mar. 1, 2005

(54) LOADER

(75) Inventor: Teijo Seppälä, Jyväskylä (FI)

(73) Assignee: Ponsse Oyj, Vierema (FI)

( * ) Notice: Subject to any disclaimer, the term of this patent is extended or adjusted under 35 U.S.C. 154(b) by 102 days.

(21) Appl. No.: 10/181,605

(22) PCT Filed: Feb. 1, 2001

(86) PCT No.: PCT/FI01/00091

§ 371 (c)(1),
(2), (4) Date: Jul. 17, 2002

(87) PCT Pub. No.: WO01/56915

PCT Pub. Date: Aug. 9, 2001

(65) Prior Publication Data

US 2003/0010741 A1 Jan. 16, 2003

(30) Foreign Application Priority Data

Feb. 1, 2000 (FI) ..... 20000202

(51) Int. Cl.[7] ..... B66C 23/683
(52) U.S. Cl. ..... 212/300; 212/231; 212/238
(58) Field of Search ..... 414/917; 212/300, 212/231, 238

(56) References Cited

U.S. PATENT DOCUMENTS 2,984,372 A 5/1961 Ferworda
3,477,588 A * 11/1969 Reischl ..... 212/238
4,015,730 A * 4/1977 Symmank ..... 414/718
5,249,643 A * 10/1993 Backer et al. ..... 182/2.11
6,405,492 B1 * 6/2002 Scheid et al. ..... 52/114

FOREIGN PATENT DOCUMENTS

| | | |
|---|---|---|
| GB | 1306434 | 2/1973 |
| SE | 315089 | 9/1969 |
| SE | 349011 | 7/1971 |
| SE | 505365 | 8/1997 |
| SU | 391990 | * 12/1973 |
| SU | 1186636 | * 10/1985 |
| WO | 9741056 | 11/1997 |

* cited by examiner

*Primary Examiner*—Thomas J. Brahan
(74) *Attorney, Agent, or Firm*—Fildes & Outland, P.C.

(57) ABSTRACT

A loader includes a base equipped with a turning device, for attaching the loader to a carrier machine, a telescopic main boom including a frame pivoted on the base, and a telescopic component arranged to move linearly in relation to it and pivoted on the base, a hinged boom pivoted on the main boom, a lifting cylinder pivoted at its first end to the base and at its second end directly or indirectly to the main boom to operate it, an arm directly or indirectly attached to the hinged boom, pivoted to the main boom, a maneuvering cylinder disposed about the main boom between the frame and the telescopic component, the telescopic component is pivoted to the arm operating the hinged boom by the first pivot, the loader includes a link rod pivoted at one end to the frame of the main boom and at the other end to the second pivot of the said arm, which is at a distance from the said first pivot.

8 Claims, 5 Drawing Sheets

LOADER

TECHNICAL FIELD

The present invention relates to a path loader for a timber handling device, which loader includes

- a base equipped with a turning device, for attaching the loader to a carrier machine,
- a main boom pivoted on the base,
- a hinged boom pivoted on the main boom,
- a lifting cylinder pivoted at its first end to the base and at its second end directly or indirectly to the main boom to operate it,
- an arm directly or indirectly attached to the hinged boom, to operate it,
- a manoeuvring cylinder attached at its first end to the main boom and at its second end to the said arm by means of the first pivot.

BACKGROUND OF THE INVENTION

Path loaders of this kind are used especially in timber harvesters. The loader carries various timber handling devices, such as a harvester component, a timber felling head, or a timber grab. The characteristics of such a loader allow it to be used to successfully perform desired operations in timber harvesting and tree felling. The predominant methods are forest thinning and final felling. The loader is generally installed on the chassis of the timber harvester by means of bolts running through a flange plate.

The use of a timber loader is previously known in a forestry machine, which loader includes a separate lifting boom and a hinged boom, as well as hydraulic cylinders operating the booms, and in which the booms operate independently of each other. Thus, the paths of the main boom and the hinged boom are not connected to each other. Thus, to create a desired path, two separate control movements must be made simultaneously. Timber harvesting usually involves an essentially horizontal path. Such a path is quite difficult to achieve by manual operation, which generally results in a path that bounces up and down, which is detrimental to both the load and the equipment.

Publication U.S. Pat. No. 5,197,615 discloses a so-called wide-angle joint, in which the movements of the booms are also connected to each other. Besides having a wide angle, this joint mechanism can resolve the aforementioned problem. By using only a single hydraulic cylinder, the free end of the pendulum boom makes an essentially horizontal movement (FIG. 4). The same figure also shows a typical wide-angle joint construction, in which the outer boom is operated by means of an arm that is separately attached to the inner boom with the aid of a connector bar.

International patent publication WO97/41056 discloses a loader showing two other joint mechanisms that can resolve the aforementioned problem. The joint mechanism of the wide-angle joint featured in FIG. 1 has a construction that is simple, but which demands extremely precise dimensioning. FIG. 2 shows a simplified version of the joint construction, in which the operations of the booms are connected together. In this case, the lower end of the hydraulic cylinder operating the hinged boom is pivoted to the main boom and the upper end is pivoted to the hinged boom's extension, which forms a straight arm operating the hinged boom. It should be noted in this case that the main boom, the hinged boom extension, and the cylinder form a triangle, in which the angle between the two sides of constant length is altered by altering the length of the cylinder. In the case of FIG. 2, the paths of the booms are connected to each other by means of the lifting cylinder, in such a way that its lower end is pivoted in a known manner to the base and its upper end to an extension of the hinged boom, in fact to the same pin as the manoeuvring cylinder.

SUMMARY OF THE INVENTION

The present invention is intended to create a more powerful loader than the prior art with the same weight and dimensions. This is achieved by a loader which includes a base equipped with a turning device, for attaching the loader to a carrier machine, a main boom pivoted on the base, a hinged boom pivoted on the main boom, an arm directly or indirectly attached to the hinged boom, to operate the hinged boom, a maneuvering cylinder attached at its first end to the main boom and at its second end to the said arm by a first pivot, and a lifting cylinder pivoted at its first end to the base and at its second end to the said arm by a third pivot and thus indirectly to the main boom to operate it so that the desired path is achieved by operating only the maneuvering cylinder. The loader is characterized in that the main boom is telescopic and comprises a frame pivoted to the base and a telescopic component arranged to move linearly in relation to it. The maneuvering cylinder is arranged to operate the telescopic component in relation to the frame of the main boom and the telescopic component is pivoted to the arm operating the said hinged boom by the said first pivot. The loader includes a link rod pivoted at one end to the frame of the main boom and at the other end to the second pivot of the said arm, which is at a distance from the said first pivot and at a distance from the said third pivot.

In one arrangement the maneuvering cylinder is located inside the frame of the main boom. The lifting cylinder is located above the main boom. The said arm is part of a wide-angle joint, in which the arm operates the hinged boom through a power rod and the said arm is a fixed extension of the hinged boom.

The telescopic main boom may include sliding guides located between the frame and the upper part of the telescopic component, to permit linear movement and at least one roller located between the frame and the telescopic component, to permit the linear movement.

The link rod and its pivots are arranged to carry lateral loads.

More specifically, the device according to this invention is principally characterized by the main boom being telescopic, having a frame pivoted on its base and a telescopic component arranged to move linearly in relation to it. The maneuvering cylinder of the loader is arranged to operate the telescopic component in relation to the frame of the main boom, the telescopic component being pivoted around the first joint of the arm operating the hinged boom. The loader includes an link rod pivoted at one end to the frame of the main boom and at its other end to the said arm by means of a second pivot, which is a distance to the said first pivot.

When examining the invention, the general term booms are used for the lifting and hinged booms. The lifting cylinder can include not only the actual lifting cylinder, but also the mechanism. The lifting and manoeuvring cylinders that control the booms are also termed the operating cylinders. Considerable advantages are achieved by means of the invention. In the loader that is the object of the invention, the lifting cylinder is arranged to lie on top of the main boom, where it is close to the carrier machine and is protected when the loader moves. This achieves a narrower construction, giving the machine operator a clearer field of vision than in the case of known constructions. According to one embodiment, the manoeuvring cylinder is located inside the main boom, where it is protected.

Although the joint mechanism according to the invention can be applied in connection with both a wide-angle loader and a simple pivoted loader, a particularly advantageous embodiment is the path loader wherein the maneuvering cylinder is located inside the frame of the main boom, as the synchronization can be implemented very easily, to give the end of the hinged boom an essentially straight path in the working area. According to a second embodiment, sliding guides are used to make the telescopic component of the main boom linear. According to a third embodiment, the link rod with its pivots is arranged to carry lateral forces, to reduce the moment load on the telescopic component.

In the following, the invention is described in greater detail with reference to the accompanying drawings, in which

DETAILED DESCRIPTION OF THE INVENTION

Figure 1:
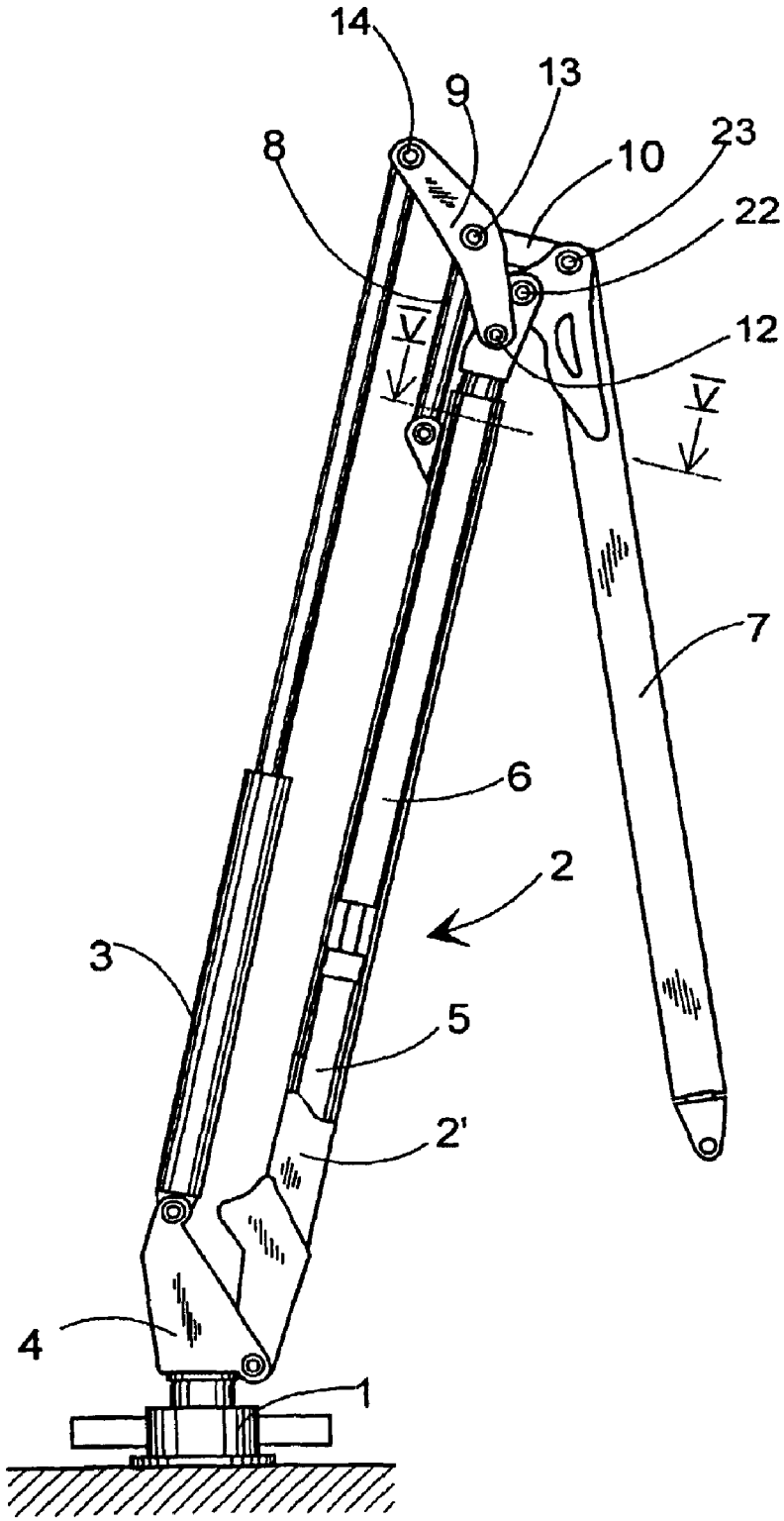
FIG. 1 shows a loader according to the invention.

FIG. 1 shows the loader according to the invention, which includes a base 1 equipped with a turning device, by means of which the loader is attached to its carrier machine. The loader's booms, comprising a main boom 2 and a hinged boom 7 are arranged on the base 1. Two cylinders are arranged to operate the booms, i.e. a lifting cylinder 3 and a manoeuvring cylinder 5. The main boom 2 is telescopic, comprising a frame 2' pivoted on the base 1 and a telescopic component 6 arranged to move linearly in relation to the main boom 2. There are sliding guides, to be described later, between the frame 2' and the telescopic component 6. The manoeuvring cylinder 5 of the hinged boom 7 is located inside the frame 2' of the main boom 2 and is arranged to operate the telescopic component 6 of the main boom 2 in relation to the frame 2' of the main boom. Manoeuvring cylinder 5 is preferably located in the bottom end of the main boom 2. The lifting cylinder 3 is located on the opposite side of the main boom 2 in relation to the hinged boom 7, essentially parallel to the main boom 2 and on the plane of movement of the booms in such a way that its first end is pivoted to the installation plate 4 of the base 1 and its second end to the arm 9, which will be described later.

The telescopic component 6 is pivoted, by means of a first pivot 12, to the arm 9 operating the hinged boom 7. In addition, the telescopic component 6 is pivoted at its end to the lower pivot 22 of the hinged boom 7. The loader includes a fixed link rod 8 pivoted at one end to the frame 2' of the main boom 2 and at the other end to the second pivot 13 of the said arm 9, which is at a distance from the said first pivot 12. Lifting cylinder 3 is located above the main boom 2 and is pivoted to the said arm 9 operating the hinged boom 7 by means of a third pivot 14, which is at a distance from the said second pivot 13, on the opposite side in relation to the said first pivot 12. Arm 9 is part of the so-called wide-angle joint, in which arm 9 operates the hinged boom 7 through a power rod 10. Power rod 10 is pivoted at its first end to the said second pivot 13 of the arm component 9 and at its opposite end to the upper pivot 23 of the hinged boom 7. Link rod 8 and power rod 10 with their pivots are arranged to carry lateral forces, thus reducing the moment load on the sliding members. In this case, the hinged boom 7 is operated with the aid of a so-called wide-angle joint, which achieves, for instance, a greater opening than when the cylinder is connected directly to the operating boom.

Figure 2:
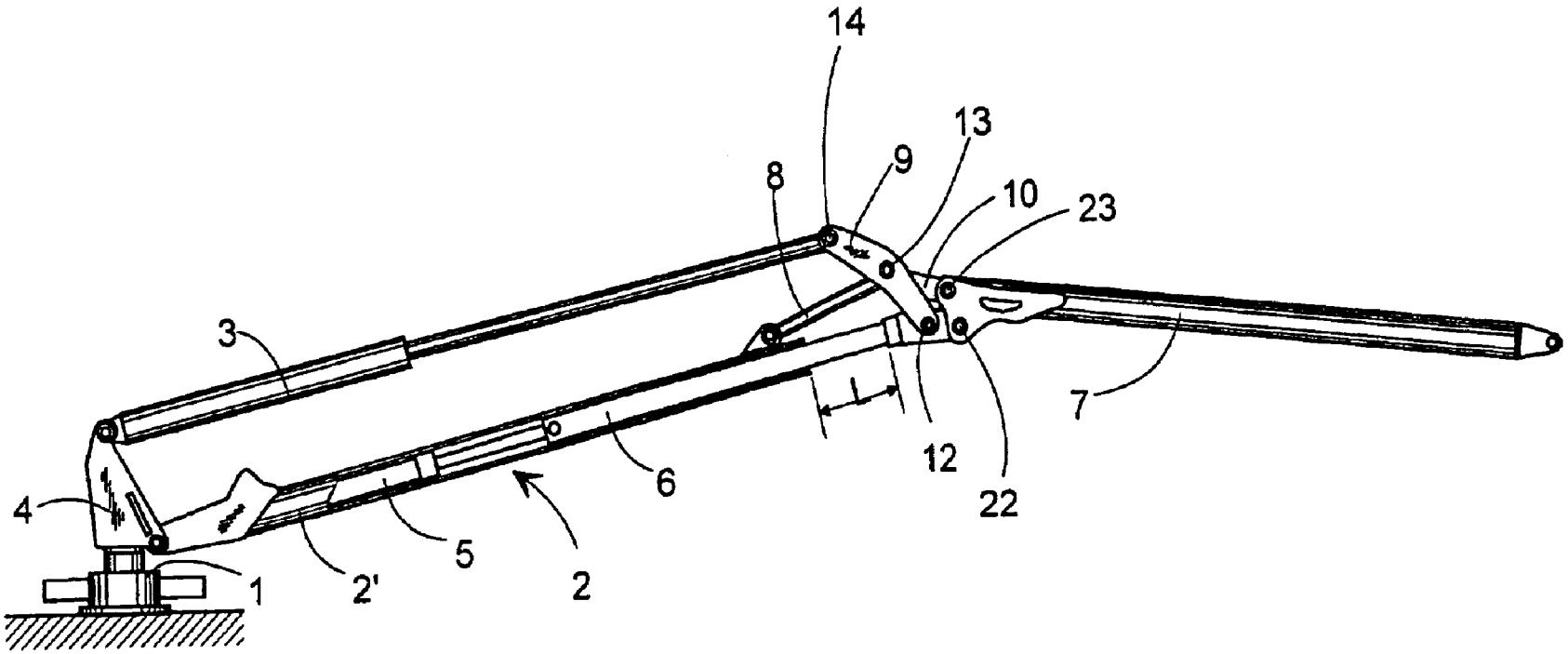
FIG. 2 shows a loader according to the invention in the stretched open position.

FIG. 2 shows the loader according to the invention in the stretched out position. The telescopic component 6 has pushed out of the frame 2' of the main boom 2 for the distance L, so that the wide-angle joint has pushed the hinged boom 7 to its maximum reach. Length L can be exploited as extra reach. The telescopic joint is protected with a flexible gaiter (not shown).

Figure 3:
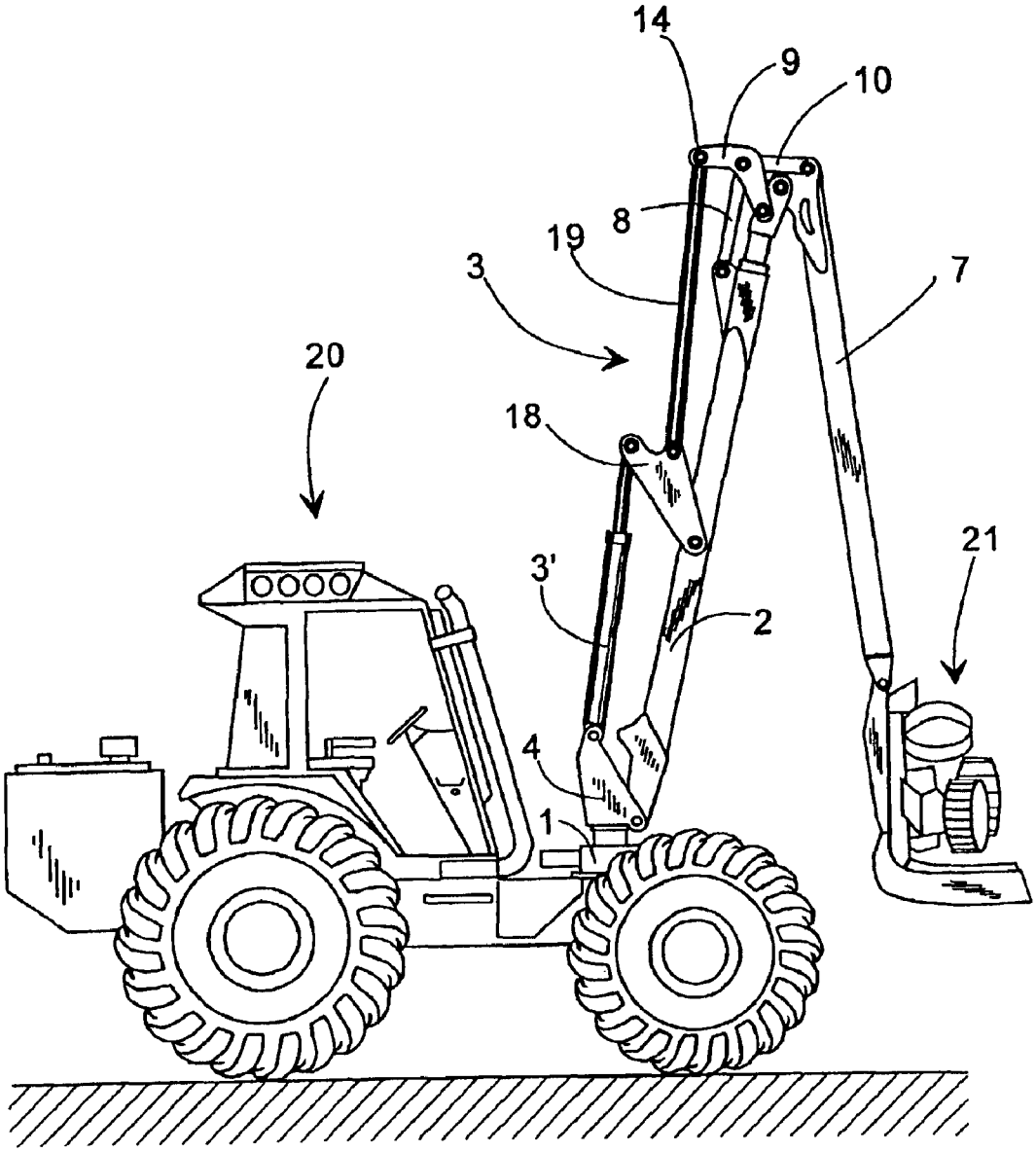
FIG. 3 shows a second loader according to the invention installed in a work machine.

FIG. 3 shows another embodiment of the loader according to the invention installed on a forest tractor 20. In this case, the load is a harvester head 21. In this embodiment, the lifting cylinder mechanism 3 is not a single structure from base 1 to arm 9, but has been replaced by a shorter actual lifting cylinder 3' and an ancillary mechanism. A link plate 18, to which the upper end of the lifting cylinder 3' is secured, is attached at essentially the middle of the main boom 2. A stabilizer bar 19, one end of which is pivoted to the said third pivot 14 of the arm 9 of the wide-angle joint, is pivoted in the link plate 18 between the pivot of the lifting cylinder 3' and the main boom 2. Joint plate 18 acts as a force converter, in which, when the stroke of the lifting cylinder 3' changes, the stroke of the stabilizer bar 19 changes in proportion. This solution reducing the danger of buckling in the piston rod of lifting cylinder 3 by reducing its length. In addition, the construction is sturdier than in the case of the single long lifting cylinder 3 shown in FIG. 1. Otherwise, stabilizer bar 19 transmits the force of the lifting cylinder 3' in the same way as a long lifting cylinder.

Figure 4:
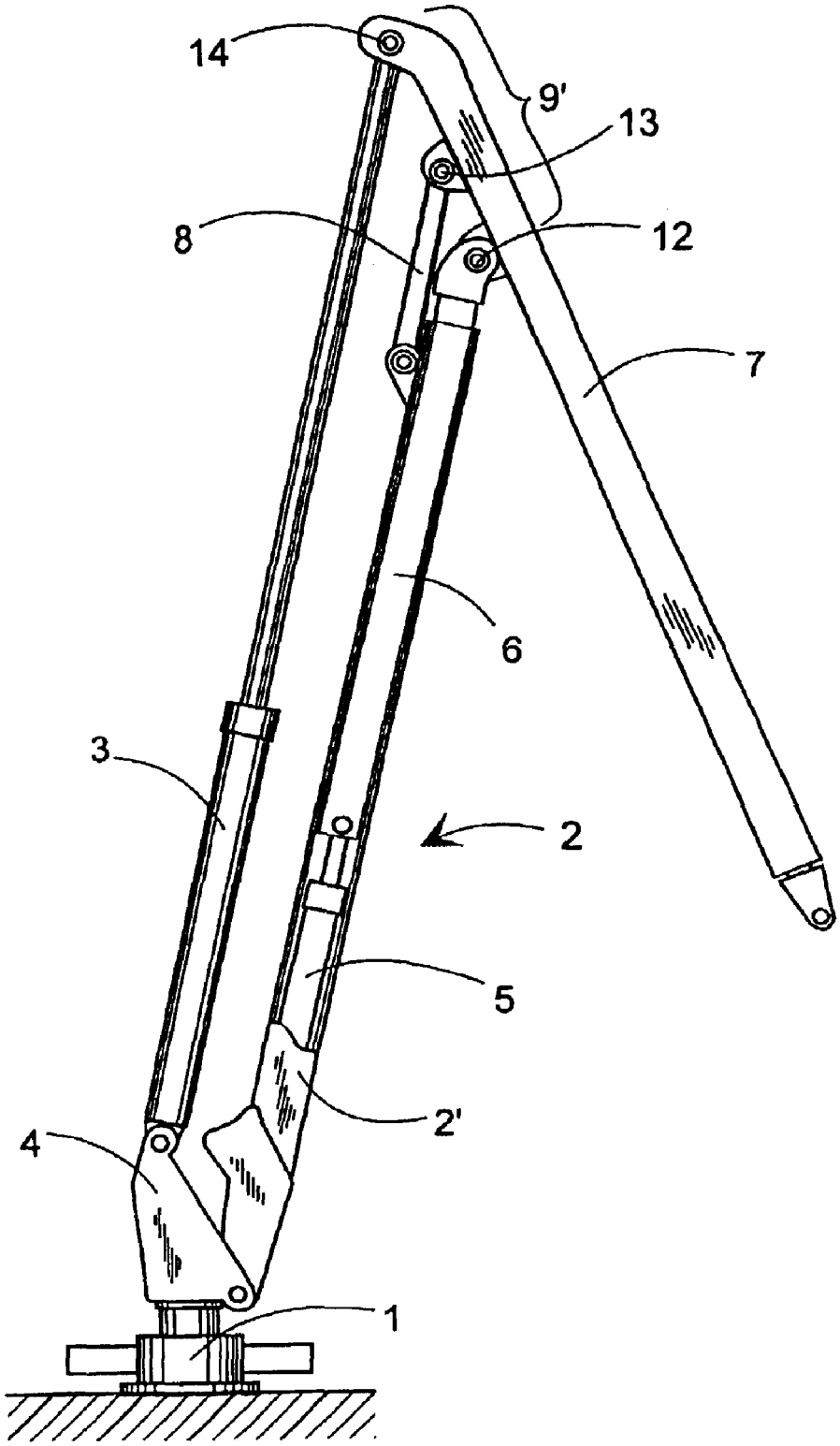
FIG. 4 shows a third loader according to the invention.

FIG. 4 shows a third embodiment of the loader according to the invention. In this form, there is no separate arm member, instead, a fixed extension of the hinged boom 7 acts as an arm 9'. The end of the telescopic component 6 of the main boom 2 is attached by means of a pivot 12 to the hinged boom 7 and thus also to the arm 9' In turn, the link rod 8 is attached to the arm 9' by means of a pivot 13 and lifting cylinder 3 is pivoted to pivot 14 at the opposite of the arm 9' to the load 21 of the hinged boom 7. In the embodiment according to FIG. 1, the elimination of the separate arm 9 and the power rod 10 simplifies the construction of the joint, though the opening angle then remains smaller.

Figure 5:
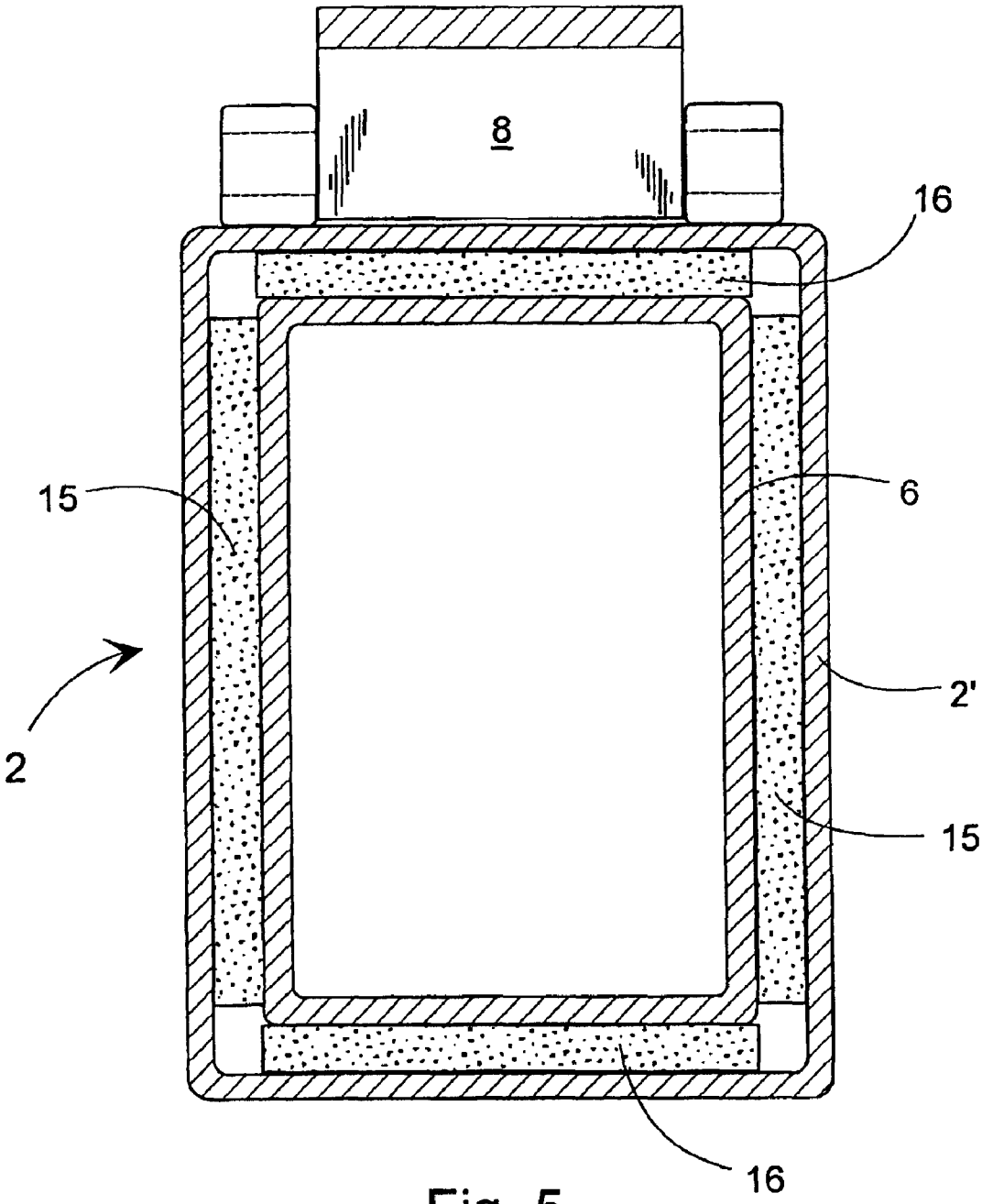
FIG. 5 shows a cross-section V—V of the loader according to FIG. 1.

FIG. 5 shows a cross-section of the loader according to FIG. 1 along the line V—V. The telescopic main boom 2 includes sliding guides 15, 16 placed between the frame 2' and the upper part 6 of the telescopic component, to permit linear movement. The sliding guides are preferably of, for example, PTFE plastic (Teflon®) or some other material with low friction and high wear resistance. The sliding guides can, on both sides, be either unified, covering the entire sliding length, or disconnected, comprising two or more pieces placed in line.

According to one other embodiment, linear movement can also be permitted by installing to the telescopic main boom 2 one or more rollers between the frame 2' and the telescopic component 6. It is often preferable to use rollers to support heavier point loads and sliding guides to support lighter loads.

The loading on the sliding guides can be substantially reduced, if the link rod 8 and the power rod 10 are arranged to also carry lateral forces and moments, thus partly transmitting lateral swinging of the load to the power rod 10 as a lateral force and so preventing the telescopic component 6 from twisting in relation to the frame 2'.

The loader according to the invention according to the embodiment of FIG. 1 operates as follows. When the loader is operated, a single control movement will cause the booms, which comprise a main boom 2 and a hinged boom 7, to stretch out or to retract. A manoeuvring cylinder 5 is arranged to control a triangle, the sides of which are formed by the link rod 8, the main boom 2, and the arm component 9. In this triangle, the length of the link rod 8 and the distance between the pivots of arm 9 remain constant. The proportion of the main boom 2, however, changes through the action of the manoeuvring cylinder. When the manoeuvring cylinder 5 is used to impose a transfer force parallel to the main boom 2 on the triangle, a change occurs in the angle between the main boom 2 and the arm 9, due to which other movements take place. When the arm 9 in FIG. 1 turns anticlockwise, it pulls the hinged boom 7 further open, with the aid of the power rod 10. Simultaneously, the lifting cylinder 3 of the third pivot at the end of the arm 9, the length of which is unchanged, creates a reaction force, which forces the main boom 2 to lower. The movements of the booms are thus synchronized with each other. This gives the end of the hinged boom 7 an essentially horizontal path in the working area.

The loader according to the invention can be used to achieve many improvements over previously known loaders. In the construction of the loader according to the invention, the distance of the attachment point of the main boom 2 from the carrier machine 20 is small and both cylinders are located at a low level, so that the centre of gravity of the loader is quite low. This gives the carrier machine stability in variable ground and loading conditions. The additional weight created by the telescopic component 6 remains relatively small. Manoeuvring cylinder 5 is well protected inside the lifting boom. Further, because the lifting cylinder 3 is essentially on the same cross-sectional level as the main boom 2 and the hinged boom 7, the loader is quite narrow.

The cylinders 3 and 5 of the loader are protected from possible impacts from the hinged boom 7 or the work machine 21 attached to it. The manoeuvring cylinder can be made extremely reliable, as there is no need to compromise the structural length of the cylinder while components like the piston rod gaskets can be constructed in the best possible way. Telescopic extensions can be used in a known manner in the hinged boom 7. The main boom can also be installed on a post or even on a separate lifting boom.

The loader is given an ideal path for many operating purposes. The most important dimensions are the distances between the pivots of the arm and installation plate.

It should be understood that the above disclosure and the related figures are only intended to illustrate the present invention. Thus, the invention is not restricted to the embodiments presented above or to those stated in the claims, instead, many different variations and adaptations of the invention, which are possible within the scope of the inventive idea stated in the accompanying claims, will be apparent to one versed in the art.

What is claimed is:

1. A path loader for a timber handling device, which loader includes a base equipped with a turning device, for attaching the loader to a carrier machine, a main boom pivoted on the base, a hinged boom pivoted on the main boom, an arm directly or indirectly attached to the hinged boom, to operate the hinged boom, a maneuvering cylinder attached at its first end to the main boom and at its second end to said arm by a first pivot, a lifting cylinder pivoted at its first end to the base and at its second end to said arm by a third pivot and thus indirectly pivoted to the main boom to operate said main boom so that a desired path of the hinged boom is achieved by operating only the maneuvering cylinder, characterized in that the main boom is telescopic, comprising a frame pivoted to the base and a telescopic component arranged to move linearly in relation to it, the maneuvering cylinder is arranged to operate the telescopic component in relation to the frame of the main boom, the telescopic component is pivoted to the arm by said first pivot, the loader includes a link rod pivoted at one end to the frame of the main boom and at the other end to a second pivot of said arm, which is at a distance from said first pivot and at a distance from said third pivot.

2. A loader according to claim 1, characterized in that the maneuvering cylinder is located inside the frame of the main boom.

3. A loader according to claim 1, characterized in that the lifting cylinder is located above the main boom.

4. A loader according to claim 1, characterized in that the said arm is part of a wide-angle joint, in which the arm operates the hinged boom through a power rod.

5. A loader according to claim 1, characterized in that the said arm is a fixed extension of the hinged boom.

6. A loader according to claim 1, characterized in that the telescopic main boom includes sliding guides located between the frame and the upper part of the telescopic component, to permit linear movement.

7. A loader according to claim 1, characterized in that the telescopic main boom includes at least one roller located between the frame and the telescopic component, to permit linear movement.

8. A loader according to claim 1, characterized in that the link rod and its pivots are arranged to carry lateral loads.

* * * * *